US008701322B2

(12) United States Patent
Santarelli et al.

(10) Patent No.: US 8,701,322 B2
(45) Date of Patent: Apr. 22, 2014

(54) SIGN CUBE SYSTEM

(75) Inventors: Anthony Santarelli, Highland Heights, OH (US); Doug Kaiser, Brunswick, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 13/245,951

(22) Filed: Sep. 27, 2011

(65) Prior Publication Data

US 2013/0074386 A1 Mar. 28, 2013

(51) Int. Cl.
*G09F 15/00* (2006.01)
*G09F 7/18* (2006.01)

(52) U.S. Cl.
CPC ..... *G09F 7/18* (2013.01)
USPC ..... 40/659; 40/607.03

(58) Field of Classification Search
USPC ..... 40/606.01, 124.14, 124.19, 749, 659, 40/606.11, 617, 554, 412, 538, 607.13; 211/85.31, 119, 133.2; 248/218.1, 249, 248/302
See application file for complete search history.

(56) References Cited

U.S. PATENT DOCUMENTS

| | | | | | |
|---|---|---|---|---|---|
| 484,902 | A * | 10/1892 | Smith | 40/659 |
| 884,848 | A * | 4/1908 | Page | 108/101 |
| 1,953,396 | A * | 4/1934 | Dunn | 211/32 |
| 2,060,711 | A * | 11/1936 | Wright | 211/32 |
| 2,710,472 | A * | 6/1955 | Leander | 40/479 |
| 2,850,820 | A * | 9/1958 | Lersch | 40/661.03 |
| 3,015,899 | A * | 1/1962 | Ensign et al. | 40/605 |
| 3,222,517 | A * | 12/1965 | Peter | 362/350 |
| 4,353,179 | A * | 10/1982 | Jennings | 40/479 |
| 4,392,316 | A * | 7/1983 | Thomas | 40/617 |
| 4,662,096 | A * | 5/1987 | Bayless et al. | 40/607.03 |
| 4,870,769 | A | 10/1989 | Ogilvie | |
| 4,991,335 | A * | 2/1991 | Krautsack | 40/617 |
| 6,070,347 | A * | 6/2000 | Hergott | 40/320 |
| 6,364,137 | B1 * | 4/2002 | Glauth et al. | 211/186 |
| 6,571,495 | B1 | 6/2003 | Margaronis | |
| D618,281 | S | 6/2010 | White | |
| 8,205,366 | B2 * | 6/2012 | Condor | 40/124.09 |
| 2005/0241201 | A1 * | 11/2005 | Lindquist et al. | 40/642.02 |
| 2006/0283924 | A1 | 12/2006 | McDaniel et al. | |
| 2009/0235565 | A1 * | 9/2009 | Waas et al. | 40/541 |

* cited by examiner

*Primary Examiner* — Kristina Junge
(74) *Attorney, Agent, or Firm* — Christine Flanagan

(57) ABSTRACT

A sign cube system having a substantially square-shaped box portion having four substantially planar side surfaces, one closed end and one open end, and a wire support having a substantially square-shaped portion which is inserted into the open end of the box portion and a stem extending perpendicular to and vertically downward from a center of the square-shaped portion. The wire support may be attached to an upright bracket and inserted into a substantially hollow upright member of a retail merchandise display or the wire support may be attached to a stringer which extends horizontally between two upright members of the retail merchandise display.

20 Claims, 7 Drawing Sheets

SIGN CUBE SYSTEM

There are no applications related to this application.

FIELD OF THE INVENTION

The present invention is in the field of advertising, and more specifically to retail sign displays.

BACKGROUND OF THE INVENTION

Signs and/or advertisements are quite popular in retail store environments to draw a consumer's attention to a particular product or a promotion or sale on particular products. These signs and/or advertisements must be flexible and inexpensive since merchandise turnover and sales promotions happen frequently over the course of months, weeks or even days. While flexible and inexpensive, the signs and/or advertisements must also be of significant size and/or shape in order to capture the attention of retail consumers. They must also be placed on or very near to the retail merchandise display fixtures upon which the products they advertise or describe are located and must be positioned such that they can easily be seen by consumers from various locations in a retail establishment. There is therefore a need in the art for flexible, inexpensive signs and/or advertisement displays which are easily seen from a distance and which capture the attention of consumers.

SUMMARY OF THE INVENTION

A sign cube system having a substantially square-shaped box portion having four substantially planar side surfaces, one closed end and one open end, and a wire support having a substantially square-shaped portion which is inserted into the open end of the box portion and a stem extending perpendicular to and vertically downward from a center of the square-shaped portion. The wire support may be attached to an upright bracket and inserted into a substantially hollow upright member of a retail merchandise display or the wire support may be attached to a stringer which extends horizontally between two upright members of the retail merchandise display.

DETAILED DESCRIPTION OF PREFERRED AND ALTERNATE EMBODIMENTS

The retail sign cube system of the present disclosure and related inventions presents a novel way to advertise merchandise displayed on a retail merchandise display fixture, such as a tiered greeting card display. The system includes one or more sign cubes which can interchangeably be displayed upon a wire support which is directly installed or attached to a merchandise display via a screw or other attachment mechanism or may be suspended from a ceiling or other overhead structure.

Figure 3:
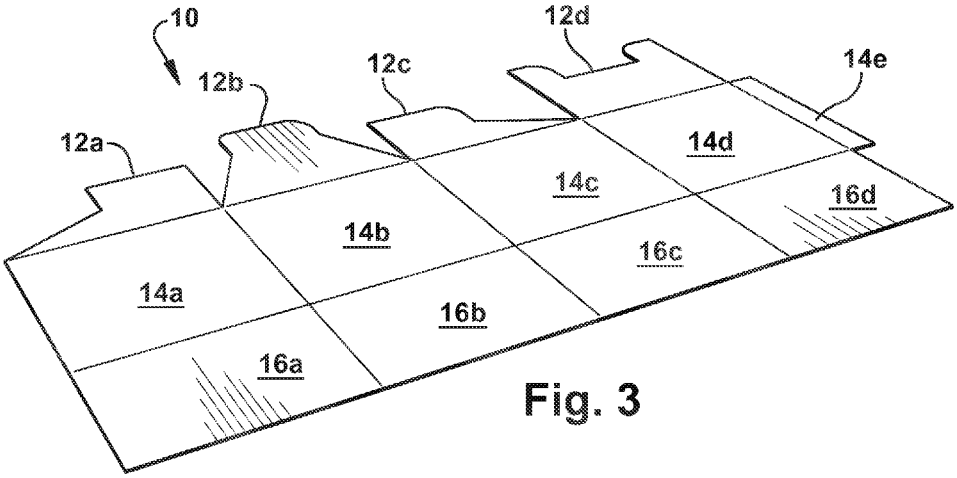
FIGS. 3-11 show various stages of assembly of the sign cube.
Figure 4:
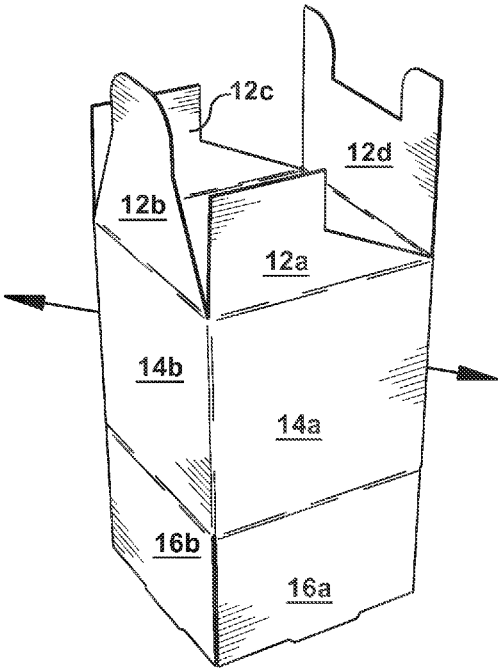
Figure 5:
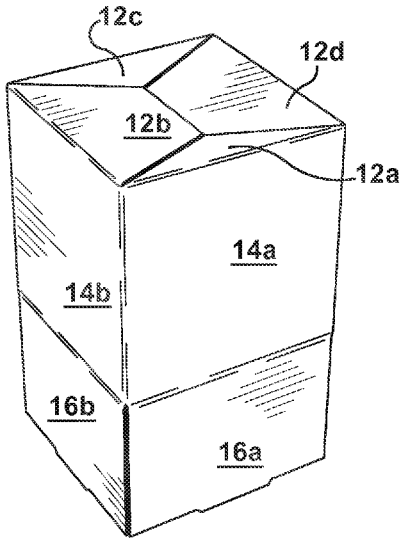
Figure 6:
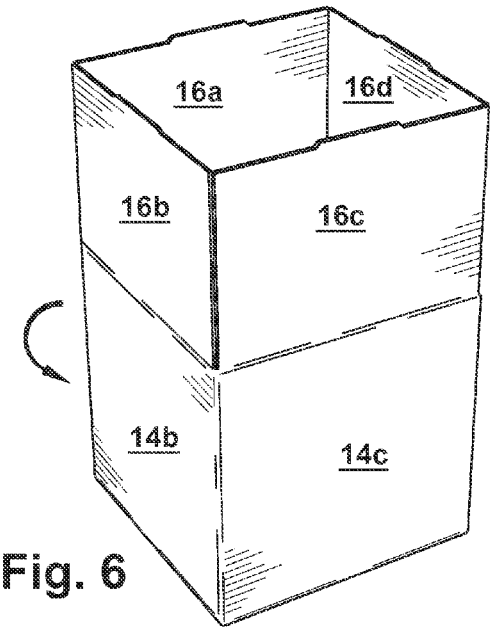
Figure 7:
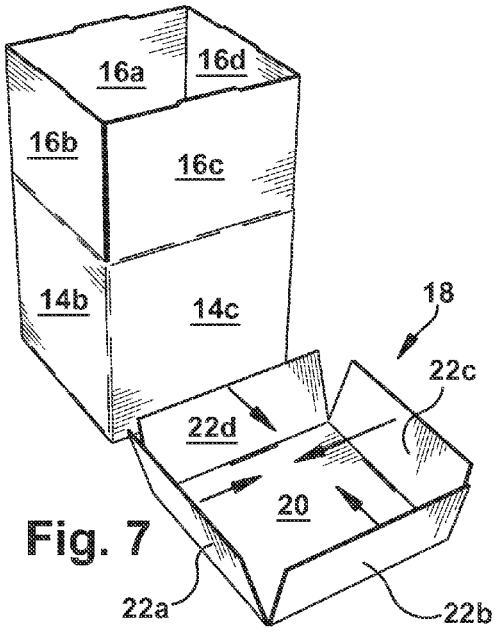
Figure 8:
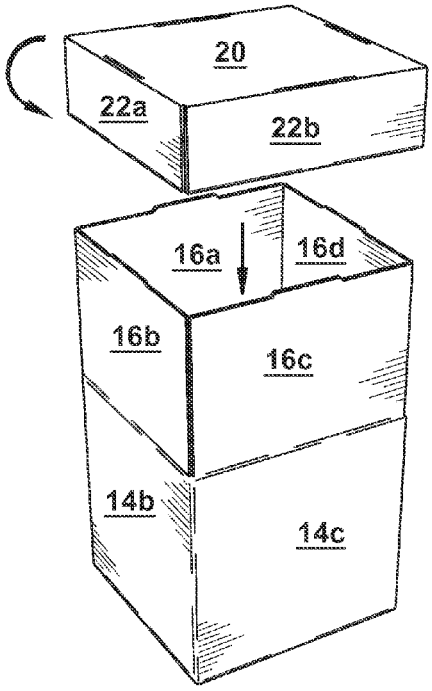
Figure 9:
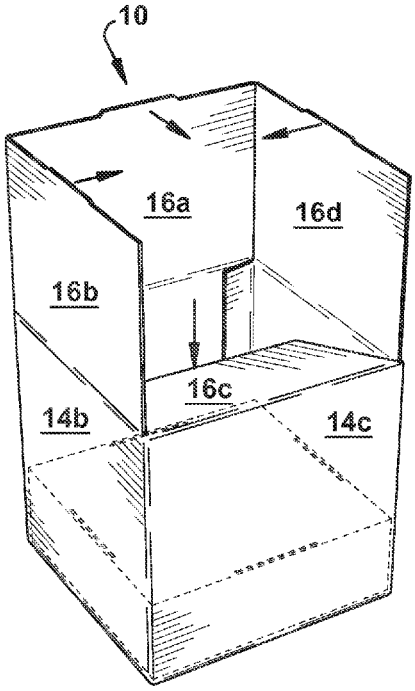
Figure 10:
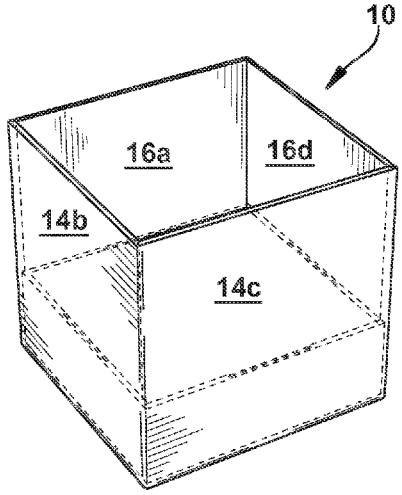
Figure 11:
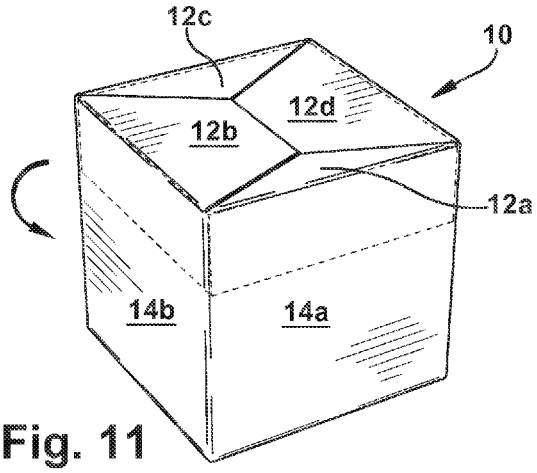

A sign cube includes a box or cube portion, a wire support and various bracketry used in attaching the sign cube to retail merchandise fixtures. The box or cube portion 10 of the sign cube is preferably made of cardboard but other lightweight but strong, durable material can be used. The terms "box" and "cube" may be used interchangeably throughout this specification to refer to the four-sided structure having one open end and one closed end and indicated generally at reference numeral 10. A box or cube blank, shown in FIG. 3, containing various panels attached along a plurality of fold lines, is assembled by strategically folding the various panels into a cube or box-like structure, as shown according to the steps of FIGS. 3 through 11. At one end the box 10 contains four locking tabs 12*a*, 12*b*, 12*c*, 12*d*, which interlock to form a closed end. The opposite end of the box 10 remains open. An intermediate row of panels 14*a*, 14*b*, 14*c*, 14*d*, serve as four planar side panels. An attachment tab 14*e* is attached to intermediate panel 14*d* and is used to connect the panels. For example, intermediate panel 14*a* may have a removable strip of tape or other adhesive attached to its inside free side edge for connection to attachment tab 14*e*, thereby forming an open-ended square structure, shown in FIG. 4. The locking tabs 12*a*, 12*b*, 12*c*, 12*d* each interlock to form a closed end, shown in FIG. 5. A group of internal panels 16*a*, 16*b*, 16*c*, 16*d* is attached to the bottom edge of each of the intermediate row of panels 14*a*, 14*b*, 14*c*, 14*d*. As shown in FIG. 6, after the locking tabs 12*a*, 12*b*, 12*c*, 12*d* are arranged to form a closed end of the cube 10, the structure is turned upside-down. A second cardboard construction or filler 18, shown in FIG. 7, is inserted into the cube 10 via the open end. The filler 18 contains a substantially square shaped panel 20 surrounded along each edge by four side tab panels 22*a*, 22*b*, 22*c*, 22*d*. Each of the four side tab panels 22*a*, 22*b*, 22*c*, 22*d* is folded upward along corresponding fold lines, turned upside down (as shown in FIG. 8), and inserted into the open end of the cube 10 and fully seated into the bottom or closed end of the cube 10. Once the filler 18 has been properly placed, the four internal panels 16*a*, 16*b*, 16*c*, 16*d* are folded inward such that the inside surface of each internal panel is parallel to and in direct contact with the inside surface of each intermediate row of panels or side panels 14*a*, 14*b*, 14*c*, 14*d*, as shown in FIGS. 9 and 10, thereby locking the filler 18 in place within the cube 10. The cube 10 is then turned upside down (closed end facing upward), as shown in FIG. 11. The sign cube therefore has four generally planar side surfaces 14*a*, 14*b*, 14*c*, 14*d* which are assembled such that each side surface is positioned at a 90-degree angle with respect to each adjacent side surface, thereby forming a square or cube. One end of the cube 10 is closed by the four locking tabs 12*a*, 12*b*, 12*c*, 12*d*, and the opposite end remains open. When fully constructed, the sign cube resembles a square box with one open end. Each of the four planar side surfaces 14*a*, 14*b*, 14*c*, 14*d* of the cube 10 may have advertising, product details and/or various graphics printed thereon. Each side surface 14*a*, 14*b*, 14*c*, 14*d* may contain identical information so that the product information may be seen from four separate directions over the merchandise display or two opposing sides of the sign cube may contain different product information based on what products are contained on each side of a double-sided merchandise display, or each side of the sign cube may contain different information and/or graphics printed thereon.

Figure 1:
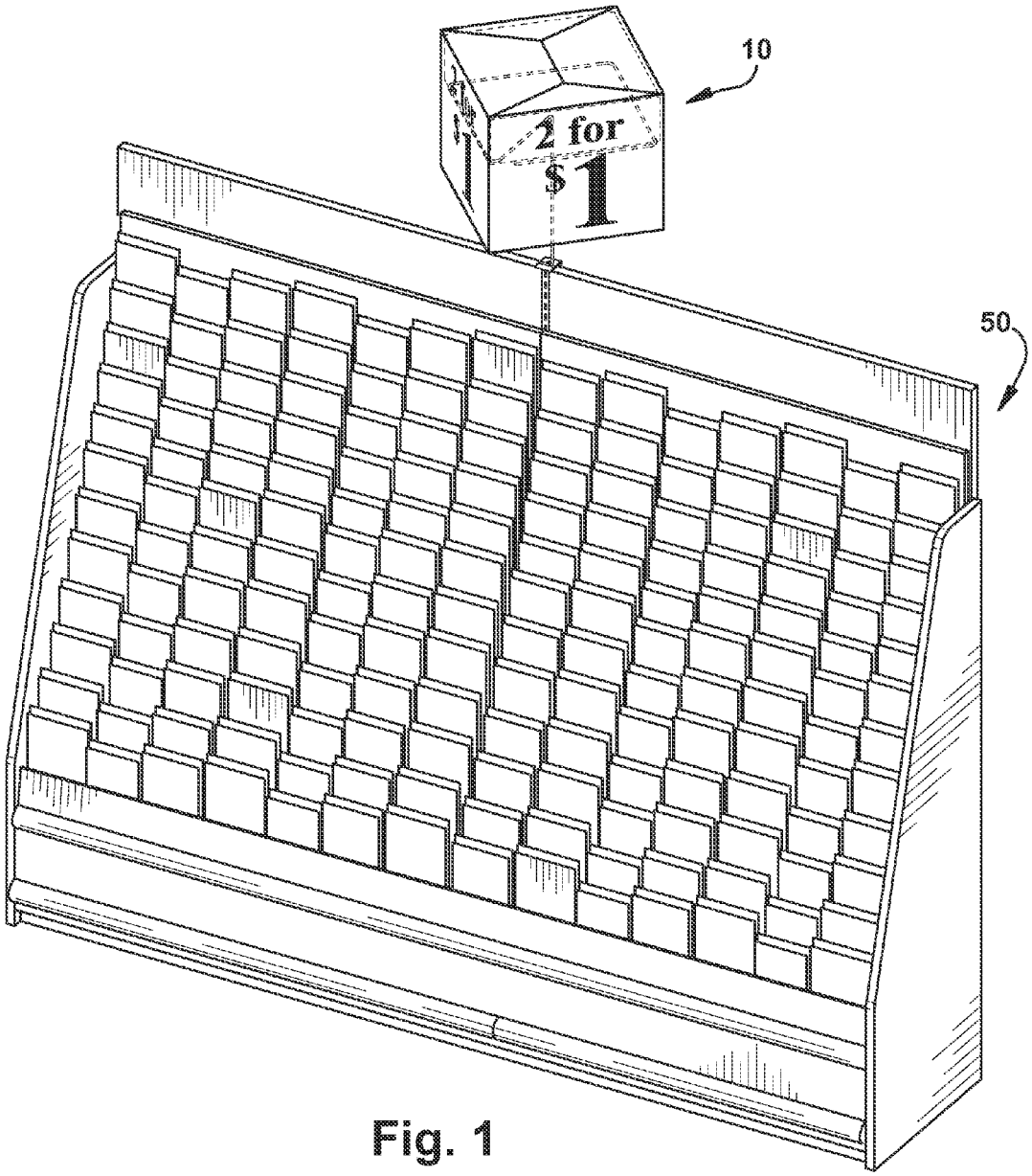
FIG. 1 is a perspective view of a sign cube of the present invention attached to a greeting card display.
Figure 2:
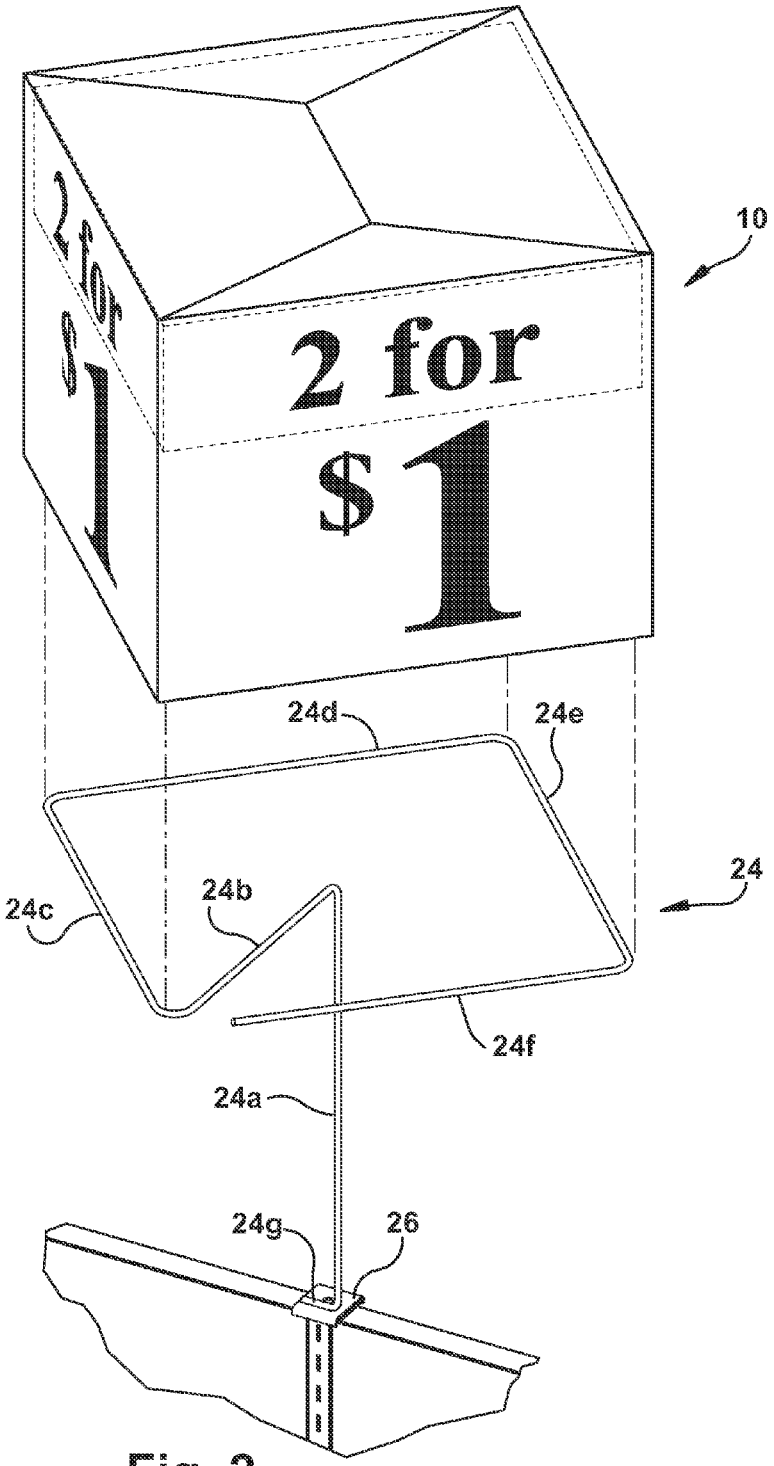
FIG. 2 is an exploded view of the sign cube and wire form.

Another component of the sign cube assembly is a wire support 24, shown in FIG. 2, which supports the sign cube and connects the entire assembly to a retail merchandise display such as a tiered greeting card display 50, shown in FIG. 1. The wire support 24 is made of a single contiguous piece of wire, which in a preferred embodiment, is 7 gauge wire. A first section of wire or stem 24*a* extends upward in a vertical direction and then extends into a second section of 24*b* that extends horizontally outward from the stem 24*a* at an approximate 90-degree angle. The second section 24*b* continues into a third 24*c* section at an approximate 45-degree angle. The third section continues into a fourth 24*d*, fifth 24*e* and sixth section 24*f* of wire. The third 24*c*, fourth 24*d*, fifth 24*e* and sixth 24*f* sections of wire are positioned at an approximate 90-degree angle with respect to one another as the wire is bent into a substantially square shape around the first section of wire or the stem 24*a*. The last or sixth section 24*f* of wire may have a free end or it may be attached to the second section 24*b* of wire forming a closed substantially square shape. At the free end of the first section or the stem 24*a*, the wire extends horizontally outward of and perpendicular to the stem, creating a small horizontal attachment section 24*g*. This attachment section 24*g* can be welded to a small square shaped plate 26 or directly to an upright bracket 28. The plate 26 contains a hole or aperture at the center of plate 26 to accommodate a screw or other attachment mechanism. The plate 26 also contains two downward angled returns. In a preferred embodiment, the third 24*c*, fourth 24*d*, fifth 24*e* and sixth 24*f* section of wire which form the square shaped structure, are each approximately 11.75 inches long, with the sixth section 24*f* having the free end being slightly shorter. Since the box or cube portion 10 of the sign cube simply sits atop the wire support 24, without a permanent attachment, the box portion 10 can quickly and easily added or removed or interchanged between wire supports 24. This feature is conducive to frequent and rapidly changing advertisement, marketing or product description details.

Figure 12:
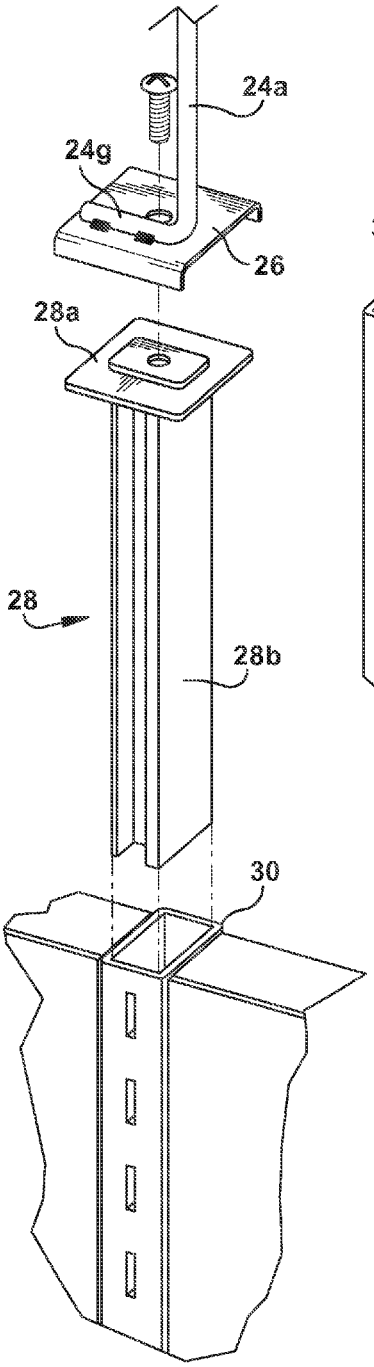
FIG. 12 is an exploded view showing attachment of a sign cube to a greeting card display using a bracket.
Figure 13:
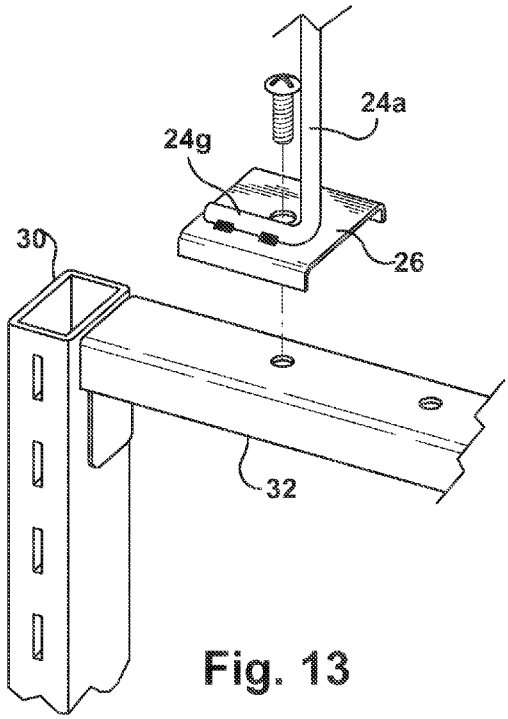
FIG. 13 is an exploded view showing the attachment of a sign cube to a stringer using a bolt.
Figure 14:
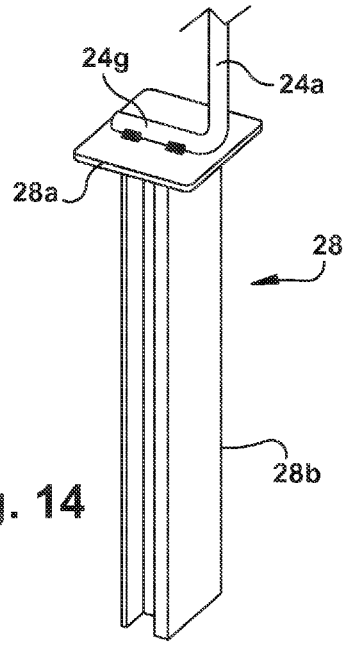
FIG. 14 is a perspective view showing the attachment of a sign cube to a bracket by welding.

The attachment plate 26 is positioned over the top of and connected to an upright bracket 28. In a preferred embodiment, the plate is approximately 1.375 inches wide and 1.298 inches long. The two downward angled returns prevent the wire support 24 from spinning about the upright bracket 28. The upright bracket 28, shown in FIGS. 12 and 14, is vertically oriented having an cap 28*a* at the top end with an opening or aperture contained thereon to accommodate connection of the wire support 24 via machine screw or other such attachment mechanism. The body 28*b* of the upright bracket 28 contains a planar backside with u-shaped channels located on the right, left and front sides of the bracket 28. The u-shaped channels operate to engage the substantially hollow upright members 30 of a retail merchandise display 50. In a preferred embodiment, the upright bracket 28 is approximately 5 inches long and the cap 28*a* at the top of the bracket 28 is approximately 1.250 inches wide. The sign cube may be attached to the upright bracket 28, which in turn is inserted into an upright member 30 of a retail merchandise display 50, as shown in FIG. 12. The wire support 24 and plate 26 may be attached to a bracket 28 using a screw, bolt or other attachment mechanism (FIG. 12). The wire support 24 may also be welded directly to the bracket 28, as shown in FIG. 14. A single bracket 28 can be inserted into an upright member 30 of a retail display 50 or one bracket 28 may be attached to each upright member 30 located at opposite ends of a display 50. Alternatively, the sign cube may be directly attached to various strategic openings on a stringer 32, as shown in FIG. 13. A stringer 32 is a horizontal rod or rail which extends between two upright members 30 of a retail merchandise display 50. For example, if the sign cube is to be positioned at the center or bisecting line of a retail display 50, then the sign cube would be attached directly to the stringer 32 at a mid-point between the two upright members 30 of the retail display 50. There may be various additional openings between the mid-point and the upright members 30 so that the sign cube can be placed at multiple points along the stringer 32 or more than one sign cube can be attached to the same stringer 32.

Figure 15:
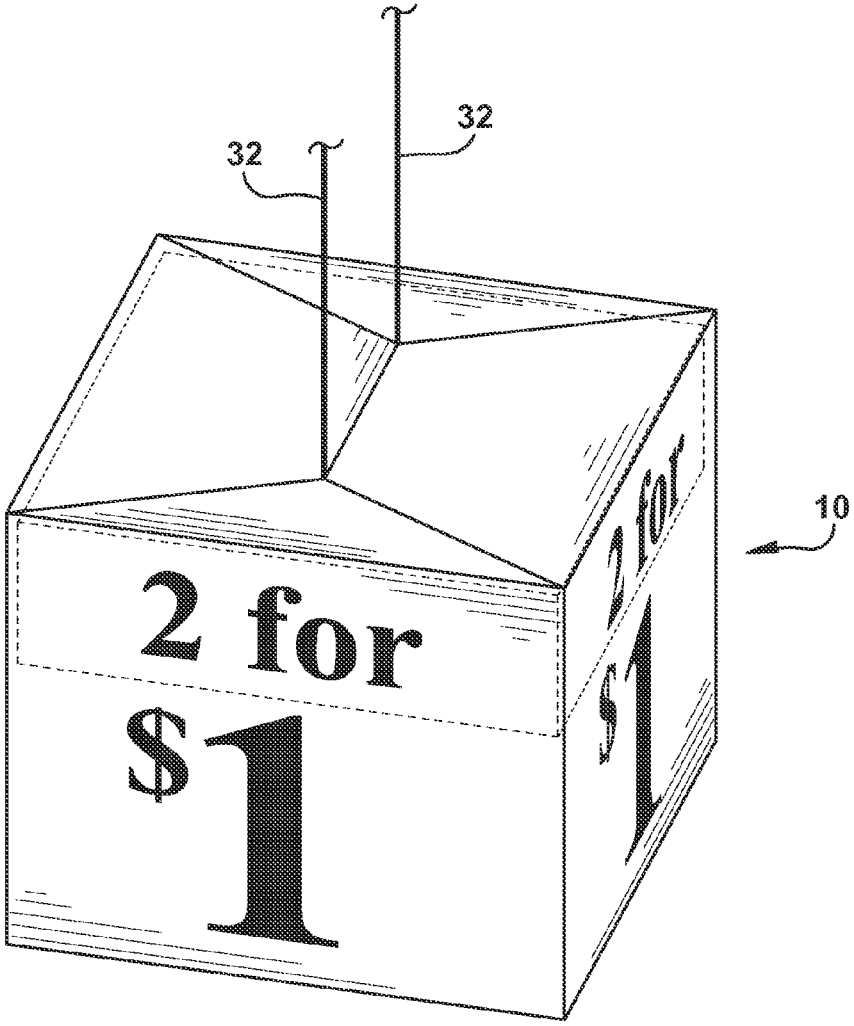
FIG. 15 is a perspective view of a sign cube with overhead suspension attachments.

Once the wire support 24 is attached to the desired location on the retail merchandise display 50, the sign cube can be inserted over the square shaped frame created by the wire support 24 until the wire support 24 is flush with the inner filler member 18. The sign cube can easily be added, removed or replaced by simply removing only the cube or box portion 10, without having to remove the wire support 24 and related bracketry. Also, in addition to placing the sign cube system directly onto the retail merchandise displays 50, the sign cube can alternatively be suspended from the ceiling or other fixture using string or other suitable attachment means, as shown in FIG. 15.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A sign cube system comprising:

a substantially square-shaped box portion having four substantially planar side surfaces, one closed end and one open end;

a filler comprising a square-shaped panel surrounded along each edge by four side tab panels, the tabs being folded along each edge and inserted into the open end of the box portion, the tabs being seated against the closed end of the box portion;

a wire support having a first leg which is connected to a second leg at an approximate 90-degree angle, the second leg being connected to a third leg at an approximate 90-degree angle, the third leg being connected to a fourth leg at an approximate 90-degree angle, the fourth leg being connected to a fifth leg at an approximate 45-degree angle, the fifth leg being connected to a stem at a 90-degree angle, the stem extending downward and perpendicularly from the fifth leg;

the wire support is inserted into the open end of the box portion and seated against the filler; and wherein the stem of the wire support may be attached to a bracket for removable attachment to a retail merchandise display.

2. The sign cube system of claim 1, wherein each of the four substantially planar side surfaces contain advertising printed thereon.

3. The sign cube system of claim 2, wherein the same advertising is printed on each of the four substantially planar side surfaces.

4. The sign cube system of claim 2, wherein each of the four substantially planar side surfaces contains different advertising printed thereon.

5. The sign cube system of claim 2, wherein at least two of the four substantially planar side surfaces contain the same advertising printed thereon.

6. The sign cube system of claim 1, wherein the stem of the wire support contains a second horizontal portion connected perpendicularly thereto between the stem and the substantially square-shaped horizontal portion of the wire support.

7. The sign cube system of claim 6, wherein the horizontal portion and the stem are contiguous.

8. The sign cube system of claim 6, wherein the horizontal portion is welded to an attachment plate and the attachment plate is attached to the bracket.

9. A sign cube system comprising:

a box portion having four sides arranged at approximate 90-degree angles to form a square structure, and four tabs which interlock to form a closed end located perpendicular to the four sides;

a filler comprising a square-shaped panel surrounded along each edge by four side tab panels, the tabs being folded along each edge and inserted into an open end of the box portion, the tabs being seated against the closed end of the box portion;

a single wire support having four legs formed into a horizontal square, a fifth leg which is connected to one of the four legs of the square and which extends inward until it is equidistant from each of the four corners of the horizontal square, and a stem which attaches to the fifth leg and extends vertically downward therefrom;

the wire support is inserted into the open end of the box portion and seated against the filler; and an attachment plate which is attached to the stem.

10. The sign cube system of claim 9, wherein the wire support is welded to the attachment plate.

11. The sign cube system of claim 9, wherein the attachment plate is connected to an upright bracket using a nut and a bolt.

12. The sign cube system of claim 11, wherein the upright bracket is inserted into a hollow upright member of a retail merchandise display.

13. The sign cube system of claim 11, wherein the attachment plate is connected to a stringer, the stringer running horizontally between two upright members of a retail merchandise display.

14. The sign cube system of claim 11, wherein the four sides of the box portion contain printed advertisements thereon.

15. A sign cube system comprising:

a box having four planar sides, a substantially planar closed top end and open bottom;

a filler comprising a square-shaped panel surrounded along each edge by four side tab panels, the tabs being folded along each edge and inserted into the open bottom of the box, the tabs being seated against the closed end of the box;

a wire structure being shaped into a square with four equal length segments, a fifth segment which is attached to one of the four equal length segments which extends into the square, the fifth segment being half the length of each of the four equal length segments, and a stem which is attached to the fifth segment, the stem being perpendicular to the fifth segment and the four equal length segments;

the stem operative to be removably attached to a retail merchandise display; wherein the four equal length segments and the fifth segment are inserted into the box proximate to the closed end of the box and seated against the filler.

16. The sign cube system of claim 15, wherein the second end of the wire structure is attached to an attachment plate, the attachment plate attached to an upright bracket, the upright bracket attached to the retail merchandise display.

17. The sign cube system of claim 16, wherein the attachment plate is connected to the upright bracket using a bolt.

18. The sign cube system of claim 16, wherein the wire structure is welded to the attachment plate.

19. The sign cube system of claim 15, wherein the second end of the wire structure is welded to one end of an upright bracket, the opposite end of the upright bracket being inserted into a hollow upright member of a retail merchandise display.

20. The sign cube system of claim 15, wherein at least one of the four planar sides of the box contain an advertisement printed thereon.

* * * * *